US007471268B2

(12) United States Patent
Shimoda

(10) Patent No.: US 7,471,268 B2
(45) Date of Patent: Dec. 30, 2008

(54) DISPLAY DRIVING CIRCUIT AND DISPLAY DEVICE USING THE SAME

(75) Inventor: Masamichi Shimoda, Tokyo (JP)

(73) Assignees: NEC Corporation, Tokyo (JP); NEC Electronics Corporation, Kanagawa (JP)

( * ) Notice: Subject to any disclaimer, the term of this patent is extended or adjusted under 35 U.S.C. 154(b) by 661 days.

(21) Appl. No.: 10/910,354

(22) Filed: Aug. 4, 2004

(65) Prior Publication Data

US 2005/0029968 A1 Feb. 10, 2005

(30) Foreign Application Priority Data

Aug. 6, 2003 (JP) ..... 2003-287260

(51) Int. Cl.
*G09G 3/30* (2006.01)

(52) U.S. Cl. ..... 345/76; 345/82; 345/98

(58) Field of Classification Search ..... 345/76, 345/77, 82, 83, 206, 98, 100; 315/169.3
See application file for complete search history.

(56) References Cited

U.S. PATENT DOCUMENTS 5,656,892 A * 8/1997 Zimlich et al. ..... 345/212
6,091,397 A * 7/2000 Lee ..... 345/690
6,989,844 B2 * 1/2006 Kageyama et al. ..... 345/89
7,253,813 B2 * 8/2007 Yamada ..... 345/207
2002/0125831 A1 * 9/2002 Inukai et al. ..... 315/169.3

FOREIGN PATENT DOCUMENTS

CN 1369916 A 9/2002
JP 2001-324955 A 11/2001
JP 2002-229513 A 8/2002

OTHER PUBLICATIONS

K. Abe et al., "16-1: A Poly-Si TFT 6-bit Current Data Driver for Active Matrix Organic Light Emitting Diode Displays", Euro Display 2002, pp. 279-282.

* cited by examiner

*Primary Examiner*—Kevin M Nguyen
(74) *Attorney, Agent, or Firm*—Sughrue Mion, PLLC

(57) ABSTRACT

An object of the present invention is to provide a display device for making it possible to accurately adjust a gradation current even if there is a variation in characteristics of a transistor for driving an organic EL element in a display device using an organic EL element. The following are included: a current detecting circuit for detecting a current circulating through a light emitting element, a current adjustment control circuit for comparing the detected current value with a reference current value and adjusting a current to be supplied to the light emitting element of a display portion in accordance with the comparison result, and a reference current circuit for generating a reference current correspondingly to the adjusted current. Moreover, a reference current circuit is formed on the substrate same as the substrate on which a light emitting element of a display portion is formed. Thereby, the variation of transistor devices constituting the reference current circuit is corrected and the reference current can be adjusted at a high accuracy.

14 Claims, 15 Drawing Sheets

DISPLAY DRIVING CIRCUIT AND DISPLAY DEVICE USING THE SAME

BACKGROUND OF THE INVENTION

1. Field of the Invention

The present invention relates to a display driving circuit and a display device using the circuit, and more particularly, to a driving circuit of a current-control light-emitting device such as an organic EL (electroluminescence) or LED (light emitting diode) in which an emitted-light brightness is controlled by a current circulating through an element, and a display device using the same.

2. Description of the Prior Art

Display devices are developed in each of which a matrix is formed by a scanning line and a data line and a light emitting element (pixel) such as an organic or inorganic EL is arranged to each intersection of the matrix to display image information. Because a display element itself emits light, these display devices do not require a backlight for illumination differently from a liquid-crystal display (LCD) and has a feature that there is no viewing angle dependency. Particularly, an active-driving display device in which an organic EL element and a transistor circuit are arranged has been particularly noticed in recent years and is expected as a display device substituted for an LCD because lower power consumption, high resolution, and high brightness can be obtained for a passive-driving display device constituted by only a light emitting element.

As a driving circuit of the active-driving display device, the following types are proposed: the voltage driving type for supplying a gradation voltage to each pixel, the current driving type for supplying a gradation current, and the digital driving type for controlling a light emitting period of a light emitting element. As a current-driving circuit, there is a circuit disclosed in "SID02 DIGEST (Euro Display 02), pp. 279~282" (Document 1). It is possible to form the driving circuit by a low-temperature polysilicon (poly-Si) thin-film transistor and therefore, has a feature of forming a circuit on a glass substrate same as a display portion.

FIG. 13 is a block diagram of a display device including the driving circuit disclosed in the Document 1, in which a driving circuit for driving a display portion 103 is constituted by a reference-current circuit 101 and a current driver 102. The current driver 102 converts a digital image signal 52 input from an external unit as a digital value into a current. FIG. 5 shows a circuit block for constituting the current driver 102, in which the digital image signal 52 serially input from an external unit is sequentially captured by a logic circuit portion constituted by a shift register 3*a*, data register 3*b*, and a latching circuit 3*c* to explode digital image signals corresponding to the number of outputs of the current driver and then latches them. A D/I converter 3*d* converts the latched digital image signal into a current and supplies the current to the pixel circuit of the organic EL display portion 103 through a data line.

The D/I converter 3*d* has the configuration shown in FIG. 7 and is basically constituted by the current copier circuit 31 shown in FIG. 6. The D/I converter 3*d* is constituted by a plurality of one-bit D/I converting circuits. In the case of 6-bit gradation display, the D/I converter 3*d* is constituted by six one-bit D/I converting circuits. In FIG. 6, two current copier circuits are used every one bit because the current copier circuits execute two operations for storing a reference current and outputting the stored reference current.

That is, because the D/I converter 3*d* has a function for storing the reference current output from a reference current circuit 101 and outputting the stored reference current to a pixel circuit, it can be said that the converter 3*d* bears a part in acting as intermediary from the reference current adjusting circuit 101 to the pixel circuit. Therefore, the reference current serving as a current to be supplied to the pixel circuit is generated by the reference current circuit 101. The configuration in FIGS. 6 and 7 will be described later because it is the same as the case of an embodiment of the present invention.

FIG. 14 shows a general reference current circuit 101 for generating a 6-bit gradation current. The reference current circuit 101 is constituted by a current-setting transistor portion 2*b* constituted by N-channel transistors and a current mirror circuit portion 2*c* constituted by P-channel transistors. To set the ratio between reference currents i1 to i6 to 1:2:4:8:16:32, the channel widths of the N-channel transistors of the current setting transistors are set at the ratio of 1:2:4:8:16:32 or the N-channel transistors are connected in parallel at the ratio of 1:2:4:8:16:32.

However, a thin-film transistor for forming a driving circuit on a glass substrate has an astronomical variation between transistors compared to a transistor to be formed on a silicon substrate. Therefore, the accuracy of a reference current value output from the reference current circuit 101 is deteriorated due to the current variation in the current setting transistor portion 2*b* and the current variation in the current mirror circuit portion 2*c* and the ratio of 1:2:4:8:16:32 which is a designed value cannot be obtained. Therefore, there is a problem that a gradation display originally required cannot be performed.

To avoid the above problem, it is also considered to form the reference current circuit 101 on the silicon substrate by moving the circuit 101 to the outside of the glass substrate. However, sufficient gradation display cannot be obtained by this method because a reference current output line extends, thereby a parasitic capacitance applied to the line increases, and it is impossible to accurately supply the current at the low current side, that is, the lowbit side to the current driver 102. Moreover, as shown in FIG. 15, the accuracy of a reference current can be obtained by adjusting each gate voltage by an adjusting resistance portion 101*c* from the outside. In this case, however, the productivity is extremely deteriorated because special adjustment is required for each display device.

Referring to Japanese Patent Application Laid-Open No. 2001-324955, a voltage to be applied to a display element is controlled by comparing a current circulating through the display element with a reference current and conforming to the comparison result in order to restrain the variation of the brightness of the display element to a temperature change or a change with time. Moreover, in Japanese Patent Application Laid-Open No. 2002-229513, a brightness change is restrained by measuring the V/I (resistance) characteristic change of a display element due to a temperature change or change with time. Therefore, a small current is supplied to the display element to measure a voltage and correct and control the voltage applied to the display element.

However, also in the techniques disclosed in the Japanese Patent Application Laid-Open, it is clear that the accuracy of the above reference current value cannot sufficiently be obtained.

BRIEF SUMMARY OF THE INVENTION

It is an object of the present invention to provide a display driving circuit for accurately generating a reference current even if there is a variation in characteristics between transistors and realizing a clear gradation display and a display device using the circuit.

It is another object of the present invention to provide a display driving circuit whose productivity is not deteriorated by adjusting a reference current and a display device using the circuit.

A display driving circuit of the present invention is a display driving circuit which comprises reference current supplying means for supplying a current to be a reference and supplies a current to a light emitting element, the display driving circuit comprising comparing means for comparing the current circulating through the light emitting element with a target value, and adjusting means for adjusting the reference current of the reference current supplying means in accordance with the comparison result.

Moreover, another display driving circuit of the present invention is a display driving circuit which comprises reference current supplying means for supplying a current to be a reference and supplies a current to a light emitting element, the display driving circuit comprising storing means for previously storing an adjustment value for adjusting the reference current of the reference current supplying means, and means for reading the adjustment value stored in the storing means and adjusting the current of the reference current supplying means.

A display device of the present invention includes either of the above display driving circuits.

DETAILED DESCRIPTION OF THE PREFERRED EMBODIMENTS

Figure 1:
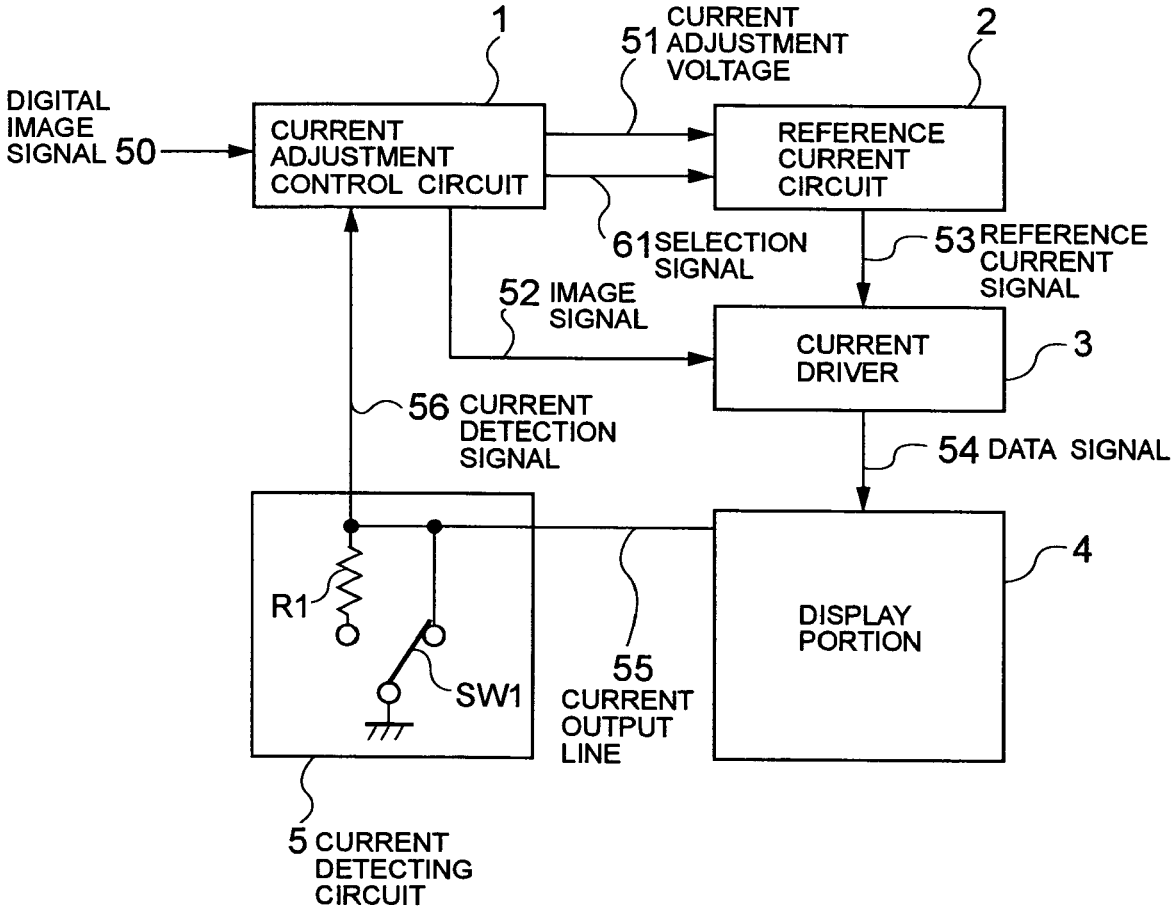
FIG. 1 is a general circuit block diagram showing a configuration of an embodiment of the present invention.

An embodiment of the present invention is described below in detail by referring to the accompanying drawings. FIG. 1 is a general block diagram of the embodiment of the present invention. In FIG. 1, a display device of the present invention is constituted by a current adjustment control circuit 1, a reference current circuit 2, a current driver 3, a current detecting circuit 5 for introducing a current circulating through a plurality of organic EL elements from a current output line 55 to detect the current by a resistance R1, and a display portion 4 in which pixel circuits including the organic EL elements are arranged like a matrix. It is assumed that this embodiment is an organic EL display device having 64 gradations for each color of RGB and a performance of color-displaying 260,000 colors. It is assumed that the switch SW1 of the current detecting circuit 5 switches the current output line 55 to the earth (GND) side and the resistance R1 side and switching-controlled by the current adjustment control circuit 1.

The current adjustment control circuit 1 outputs a reference-current adjustment signal (current adjustment voltage 51) based on the detection result by a current circulating through an organic EL element. The reference current circuit 2 generates a reference current constituted by 6 colors and outputs them to the current driver 3 as a reference current signal 53. The current driver 3 converts the digital value of the digital image signal 52 input from the outside into a current (data signal 54) by using the reference current signal and outputs it to the display portion 4. A pixel circuit constituting the display portion 4 stores the data signal 54 output from the current driver 3 and outputs a current equal to the data signal 54 to an organic EL element. As a result, the organic EL element emits light at a brightness decided by the data signal 54.

Figure 2:
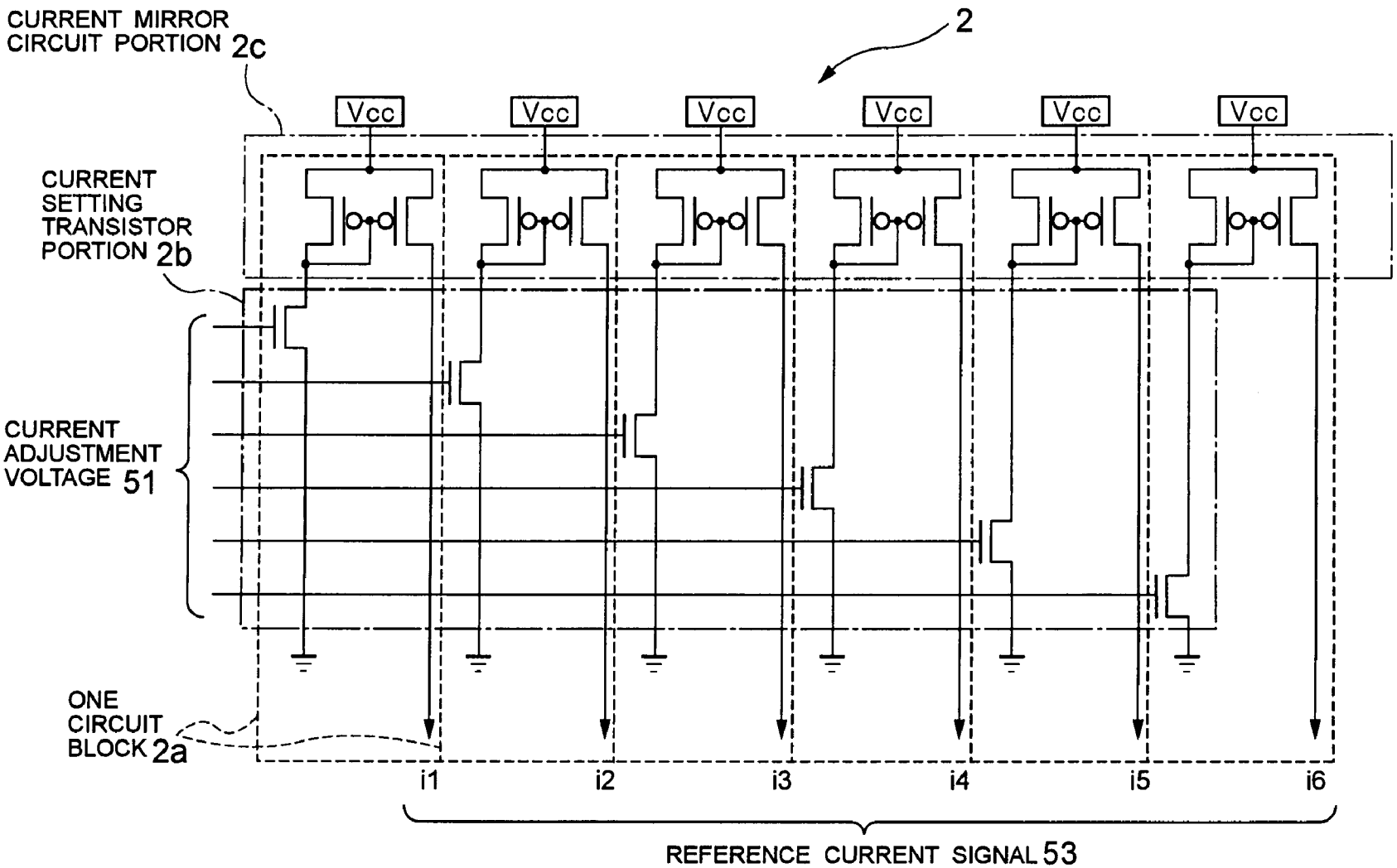
FIG. 2 is a circuit diagram showing an example of the reference current circuit 2 shown in FIG. 1.

FIG. 2 shows a circuit diagram of the reference current circuit 2 shown in FIG. 1. Because the diagram is shown as a circuit corresponding to one color of RGB, three circuits are used for the whole reference current circuit 2. Because of 64 gradation display, the circuits are constituted by six circuit blocks (circuit block is shown by 2*a*) corresponding to six reference current signals of each color (i1 to i6) and as a whole, constituted by 18 circuit blocks by including 18 reference current signals. One circuit block 2*a* is constituted by a current-setting transistor portion 2*b* constituted by an N-channel transistor and a current mirror circuit portion 2*c* constituted by two P-channel transistors having the same channel length and the same channel width.

By changing the gate voltage of the current-setting transistor, the current of the current mirror circuit is decided. Therefore by changing the current adjustment voltage 51, it is possible to change the current value of the reference current signal 53. The current ratio between six signals of each color of RGB is set to i1:i2:i3:i4;i5:i6=1:2:4:8:16:32 and current values between RGB are set to different values in accordance with the characteristic of an organic EL element of each color of RGB.

Figure 3:
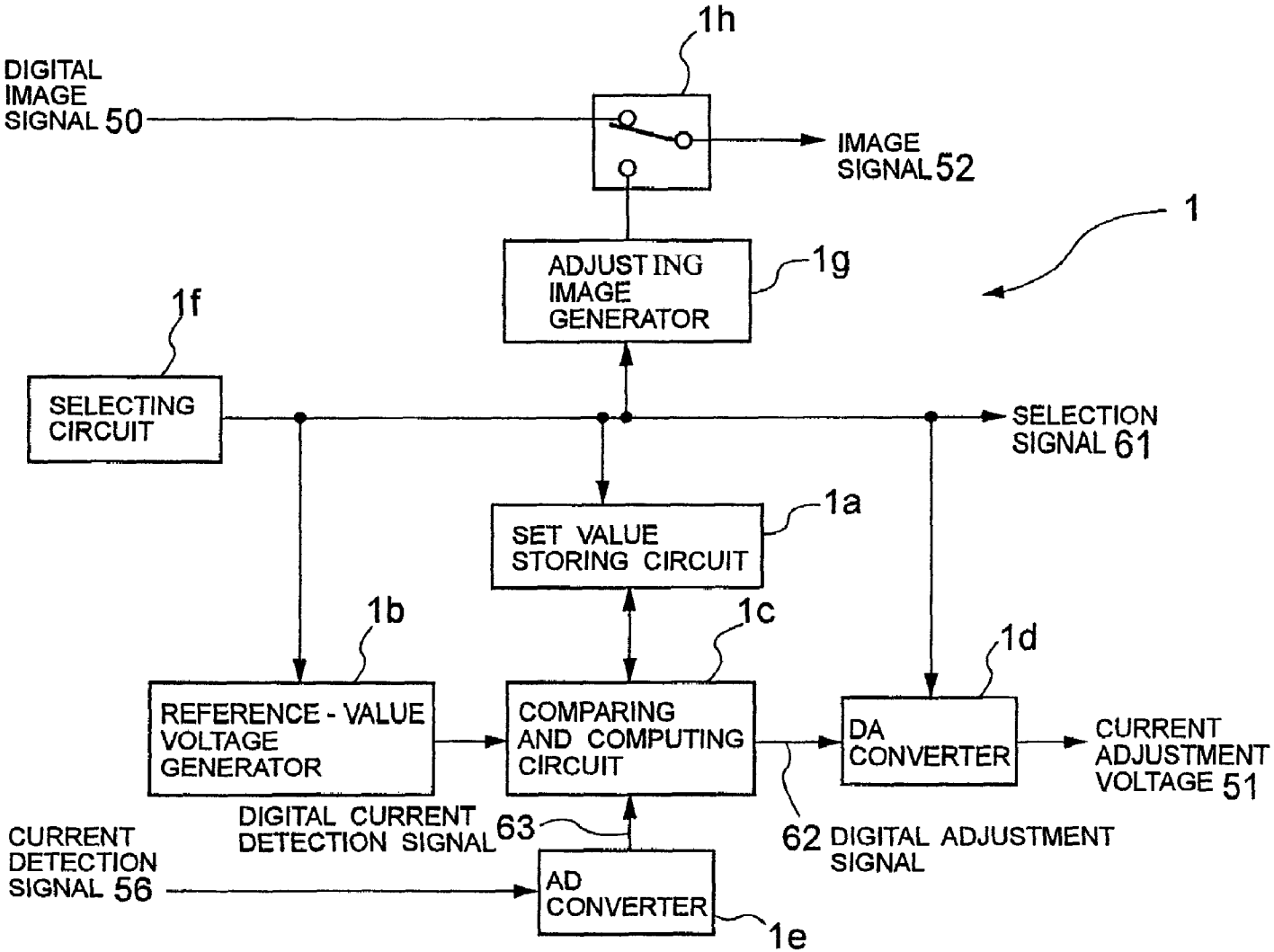
FIG. 3 is a block diagram showing an example of the current adjustment control circuit 1 shown in FIG. 1.

FIG. 3 shows an internal block diagram of the current adjustment control circuit 1 shown in FIG. 1. The current adjustment control circuit 1 is constituted by a set-value storing circuit 1*a*, reference-value storing circuit 1*b*, comparing and computing circuit 1*c*, DA converter 1*d*, AD converter 1*e*, selecting circuit if, adjusted-image generator 1*g*, and switch 1*h*.

The selecting circuit 1*f* outputs a selection signal 61 for selecting the circuit block of the reference current circuit 2. Moreover, the selection signal 61 is also output to the set-value storing circuit 1*a*, reference-value storing circuit 1*b*, DA converter 1*d*, and adjusted-image generator 1*g* and a circuit or signal corresponding to the circuit block of the reference current circuit 2 is selected in each circuit.

The adjusted-image generator 1*g* outputs an image signal to be sent to the current driver 3 when adjusting a reference current. An image signal to be output is prepared for each circuit block of the reference current circuit 2 and selected by the selection signal 61. For example, when adjusting a reference current signal 53 (i1) of Red, a six-bit image signal to be output is set to #000001 in binary notation and other six-bit image signals of Green and Blue are set to #000000. As a result, the value of the reference current signal 53 is supplied to all organic EL elements and adjusted.

Then, when adjusting the reference current signal 53 (i2) of Red, six-bit image signals of Green and Blue are not changed but they are left as #000000 and the six-bit image signal of Red is shown as #000010 in binary notation. That is, 18 types of data values in which only one bit for information of the 18-bit information of RGB becomes "1" are used, output by the selection signal 61, and adjusted.

The reference-value storing circuit 1*b* is a circuit storing a target value of a current every circuit block of the reference current circuit 2 and the target value is selected by the selection signal 61 and output. Moreover, when a display device is used in which there are 40,000 pixels respectively having subpixels of RGB, a value obtained by multiplying a reference current to be set by 40,000 is used as a target value. Therefore, in the case of the target value, colors i1 to i6 respectively have a ratio of i1:i2:i3:i4:i5:i6=1:2:4:8;16:32 and a value multiplied by 40,000 is stored.

The comparing and computing circuit 1*c* compares a target value for reference current adjustment output from the reference value storing circuit 1*b* with a current value actually circulating though an organic EL element. When the target value is larger the current value, the circuit 1*c* outputs a digital adjustment signal 62 by changing it to a large value but when the current value circulating through the organic EL element is larger than the target value, the circuit 1*c* outputs the digital adjustment signal 62 by changing it to a small value. The current value actually circulating through the organic EL element is converted into a digital current detection signal 56 by the AD converter 1*e* and input to the comparing and computing circuit 1*c*.

The set-value storing circuit 1*a* is a circuit for storing a digital value shown by the digital adjustment signal 62 when a target value for reference current adjustment becomes equal to a current actually circulating through the organic EL element. Moreover, when adjustment is not performed yet, a predetermined initial value is stored and when the adjustment is completed, updated to an adjusted value. The stored data is present every circuit block of the reference current circuit 2 and a storing destination is decided in accordance with the selection signal 61.

Figure 4:
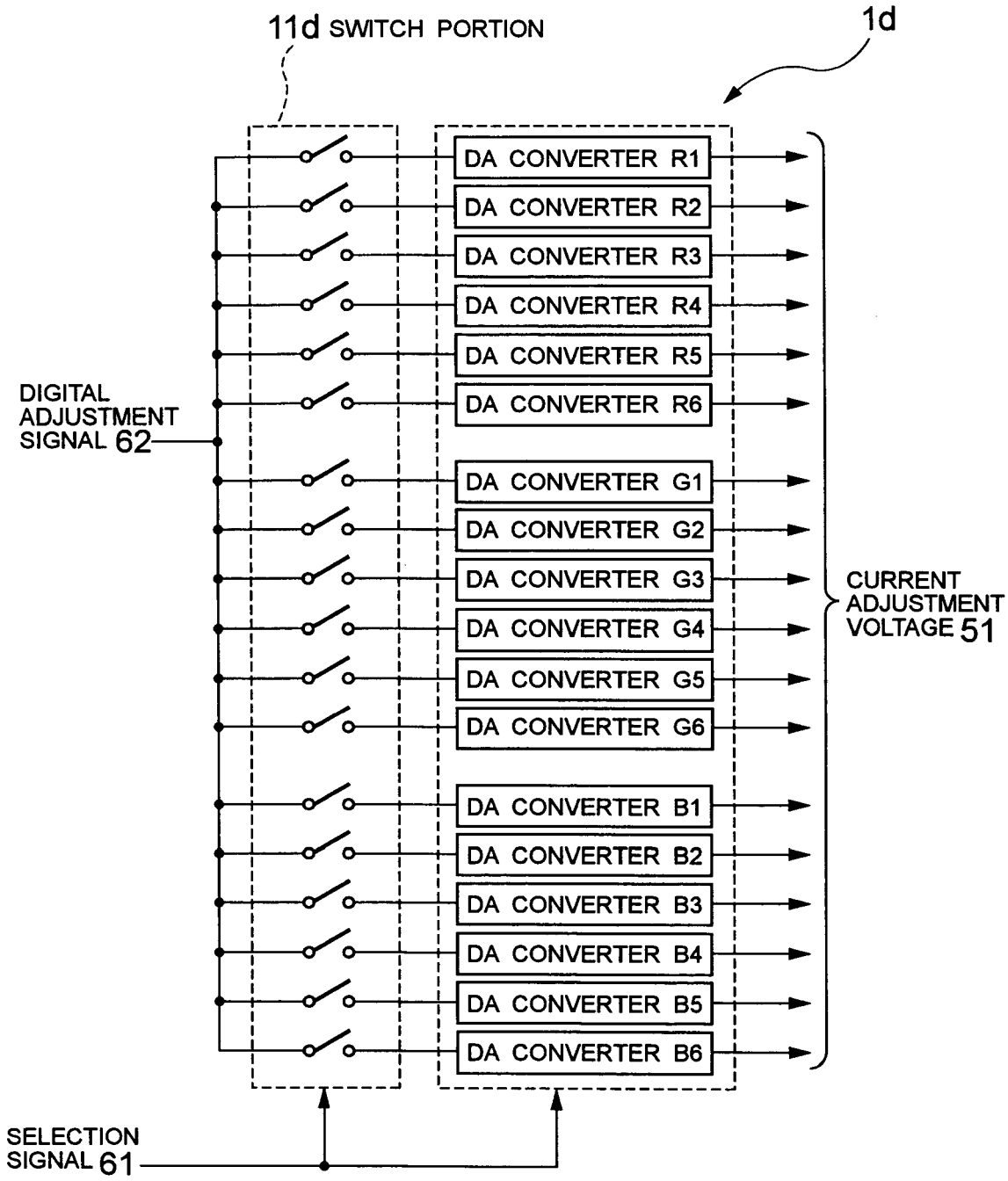
FIG. 4 is a circuit diagram showing the inside of the DA converter 1*d* shown in FIG. 3.

The DA converter 1*d* is a circuit for converting the digital adjustment signal 62 output from the comparing and computing circuit 1*c* into an analog signal and outputting the current adjustment voltage 51 for current adjustment to the reference current circuit 2 shown in FIG. 2. The DA converter 1*d* comprises a plurality of DA converters and FIG. 4 shows the internal circuit of the DA converter 1*d*. The DA converter 1*d* is constituted by 18 DA converters (R1 to R6, G1 to G6, and B1 to B6) prepared for each circuit block of the reference current circuit 2. Moreover, the converter 1*d* has a switch portion 11*d* for sending the digital adjustment signal 62 to the DA converters (R1 to R6, G1 to G6, and B1 to B6) selected by the selection signal 61.

Figure 5:
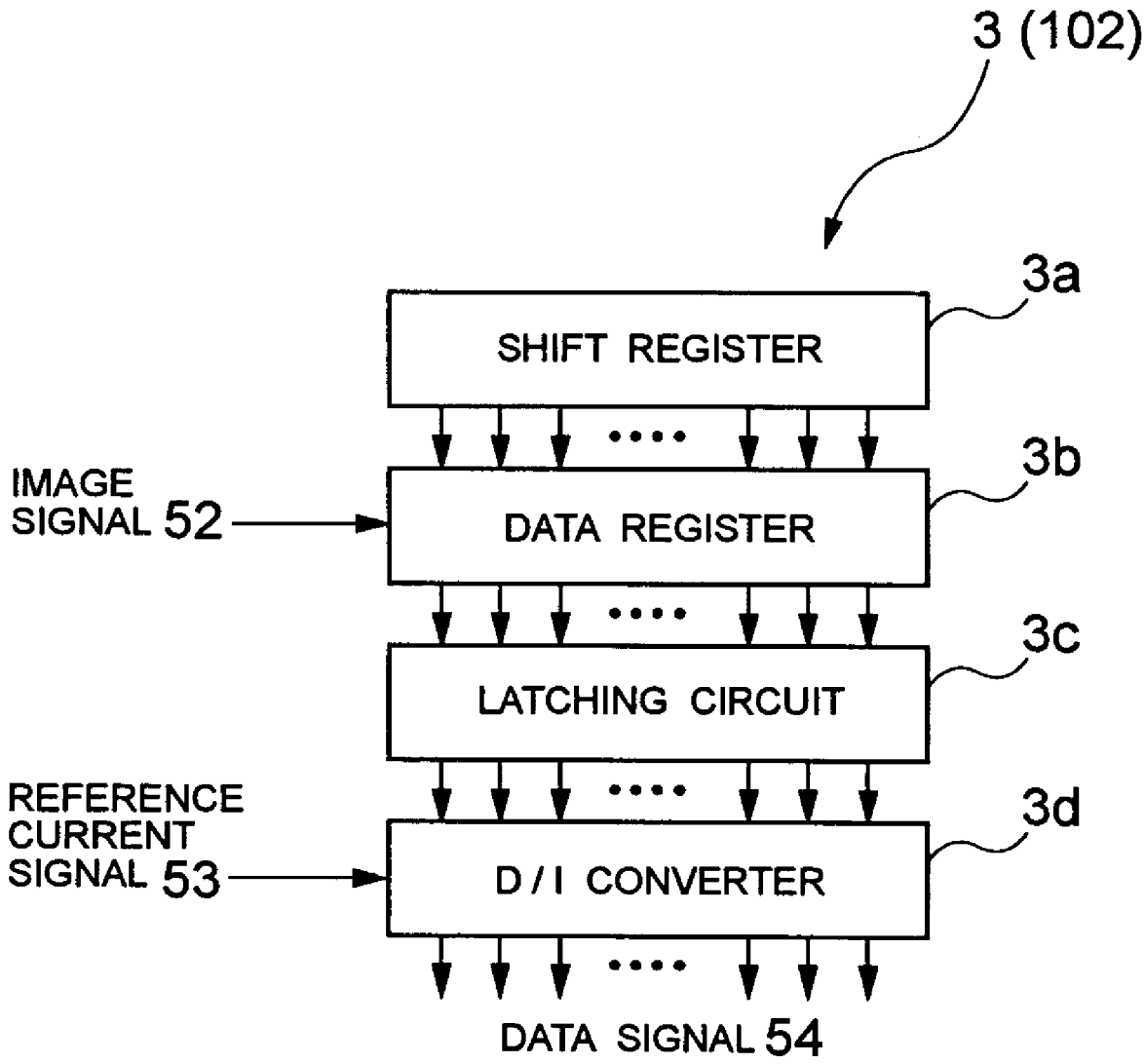
FIG. 5 is a block diagram showing the inside of the current driver 3 shown in FIG. 1.

FIG. 5 is an internal block diagram of the current driver 3 shown in FIG. 1. The current driver 3 is constituted by a shift register 3*a*, data register 3*b*, latching circuit 3*c*, and D/I converter 3*d*. The shift register 3*a* generates a signal for sequentially capturing 18 image signals 52 into the data register 3*b*. The data register 3*b* sequentially latches the image signals 52 in accordance with outputs of the sift register 3*a*.

When capturing the image signals 52 corresponding to the number of outputs of the current driver 3 is completed in the data register 3*b*, the latching circuit 3*c* latches the outputs of the data register 3*b* and outputs them to the D/I converter 3*d*. For example, when a display device having 200 pixels per line is used and the number of current driver outputs is 200×3 (RGB)=600, the shift register 3*a* becomes a circuit having 200 outputs and the data register 3*b* and latching circuit 3*c* respectively serve as a circuit for capturing 200 pixels×6 bits×3 (RGB)=3,600 bits.

Moreover, the D/I converter 3*d* is constituted by circuit blocks of 200 pixels×3 (RGB)=600, converts a 6-bit digital signal output every circuit block of the D/I converter 3*d* from the latching circuit 3*c* into a current, and outputs the current to a pixel circuit through a data line.

Figure 6:
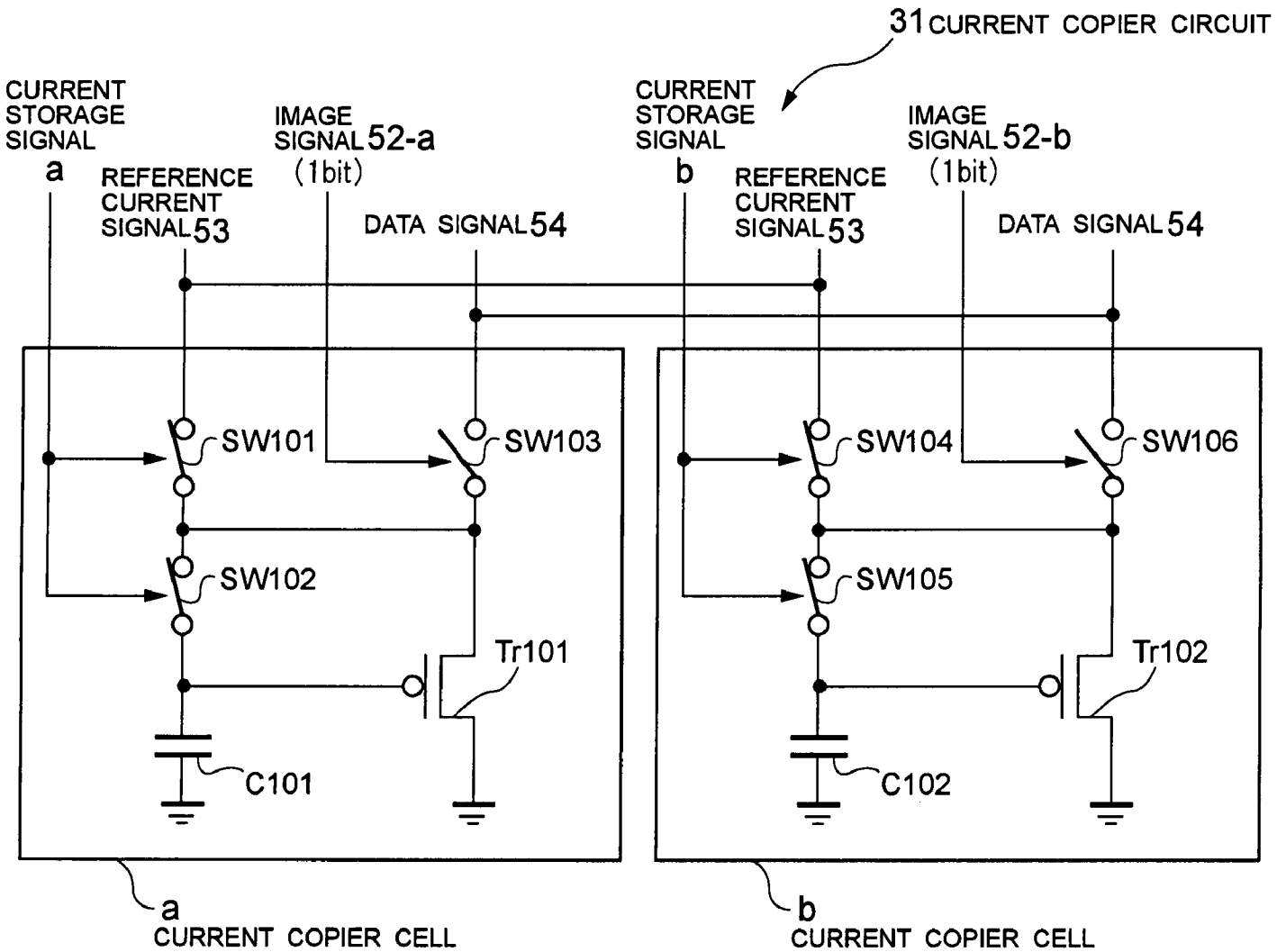
FIG. 6 is a circuit diagram showing a current copier circuit constituting the D/I converter 3*d* shown in FIG. 5.

FIG. 6 shows a current copier circuit constituting the D/I converter 3*d*. The circuit shown in FIG. 6 is a circuit corresponding to one (1-bit) pixel signal and the D/I converter 3*d* is constituted by six circuits in order to corresponding to image signals 52 of 6 bits for each color. As shown in FIG. 6, the current copier circuit is constituted by a pair circuit of current copier cells a and b. The current copier cell a is constituted by a transistor Tr101 for performing current storage and output, electrostatic capacitor C101 for holding a gate voltage, and three transistor switches SW101 to SW103 and the current copier cell b is constituted by a transistor Tr102, a capacitor C102, and transistor switches SW104 to SW106.

A pair of circuit configurations is used because current copier circuits perform two types of operations such as the current storage operation and current output operation. That is, when one current copier cell a stores the reference current signal i1, the other current copier cell b outputs a current equal to the reference current signal 53 (i1). When storing a current, voltages at the both ends of the electrostatic capacitor C101 (or C102) are charged up to a voltage necessary for the transistor Tr101 (or Tr102) to supply the reference current signal 53 (i1) and when outputting a current, the voltage is held. The switches SW101, SW102, SW104, and SW105 are transistor switches used for the storage operation, which are closed for the storage operation and opened for the current output operation by the current storage signals a and b.

The switches SW103 and SW106 are transistor switches used for the current output operation, which output the stored current when the image signal 52 is kept at high (High) level but they do not output the stored current when the signal 52 is kept at low (Low) level. The image signal 52 is by a signal to be switched every frame period divided into an image signal 52-*a* and an image signal 52-*b* and input to the current copier cells in order to input the image signal 52 only to a current copier cell which presently performs the output operation so that low level is input to a current copier cell which presently performs the storage operation.

Figure 7:
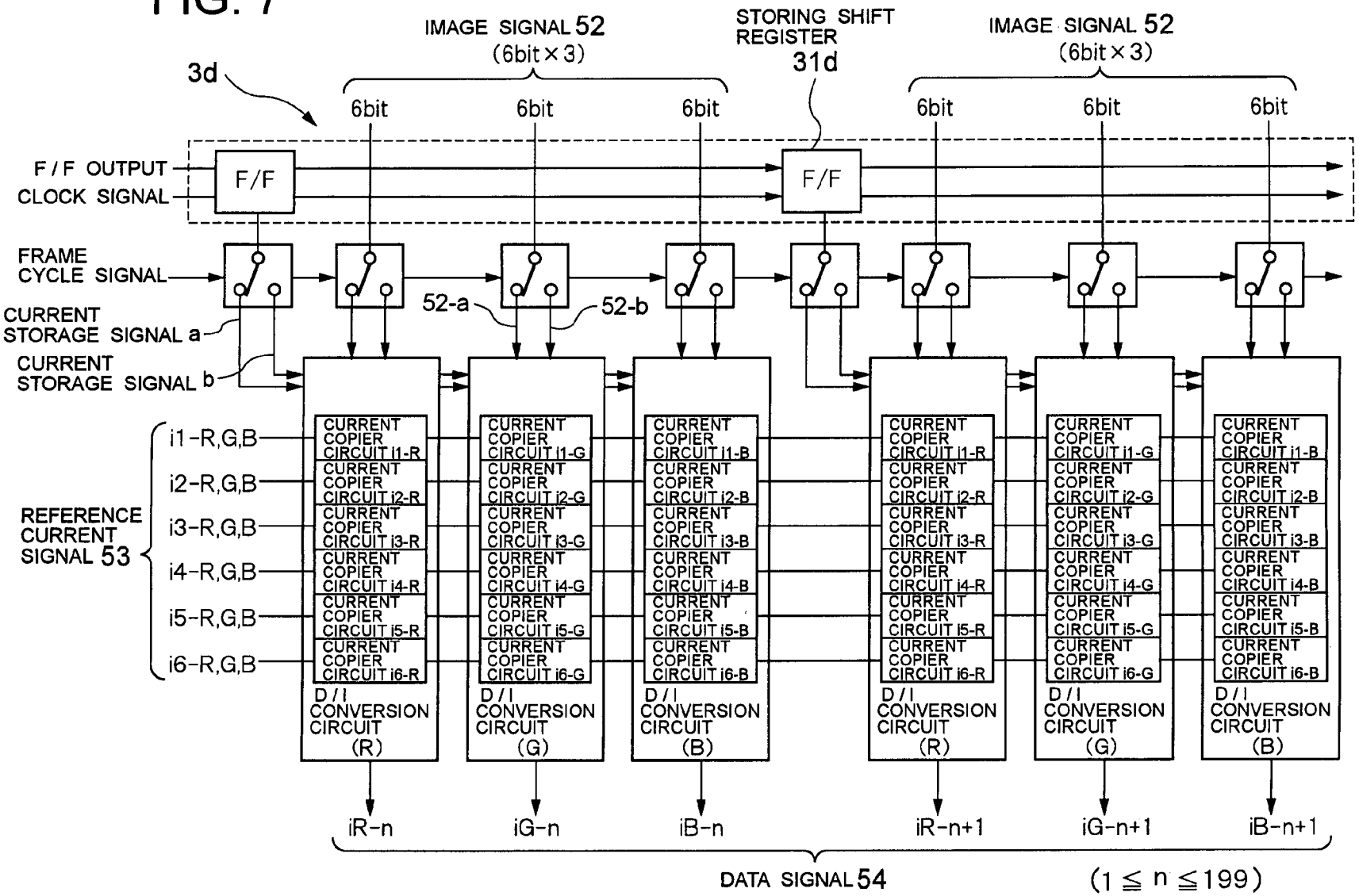
FIG. 7 is a circuit block diagram showing the inside of the D/I converter 3*d* shown in FIG. 5.

FIG. 7 is an internal block diagram of the D/I converter 3*d* shown in FIG. 5. A storing shift register 31*d* generates a current storage signal and the generated signal is input to 18 (6 for each color) current copier circuits through switches. Eighteen (6 for each color) current copier circuits sequentially store a reference current within the period of one frame in accordance with outputs of the storing shift register 31*d* and a current is stored in all circuit blocks within the period of one frame.

Moreover, the current copier circuit in FIG. 7 is the circuit shown in FIG. 6. In FIG. 7, switches are operated in accordance with a frame cycle signal to be switched every frame input from the outside. An output of the storing shift register 31*d* is switched as the current storage signal a or b by the switch and the current storage signal is sent only to the current copier cell at the storage side. The current copier circuits respectively correspond to reference current signals 53 constituted by 6 colors of RGB (total of 18 colors) and 18 reference current signals 53 are stored in each circuit.

Moreover, the current copier circuits correspond to image signals 52 of 6 bits for each color of RGB and output 64 types of currents in accordance with combinations of i1 to i6 having a ratio of i1:i2:i3:i4:i5:i6=1:2:4:8:16:32 for each color in accordance with digital values shown by the image signals 52.

Currents corresponding to display of 64 gradations shown by the digital image signals 53 are generated by the D/I converter 3*d* having the configuration in FIGS. 7 and 6 and output to a pixel circuit as data signals 54.

Figure 8:
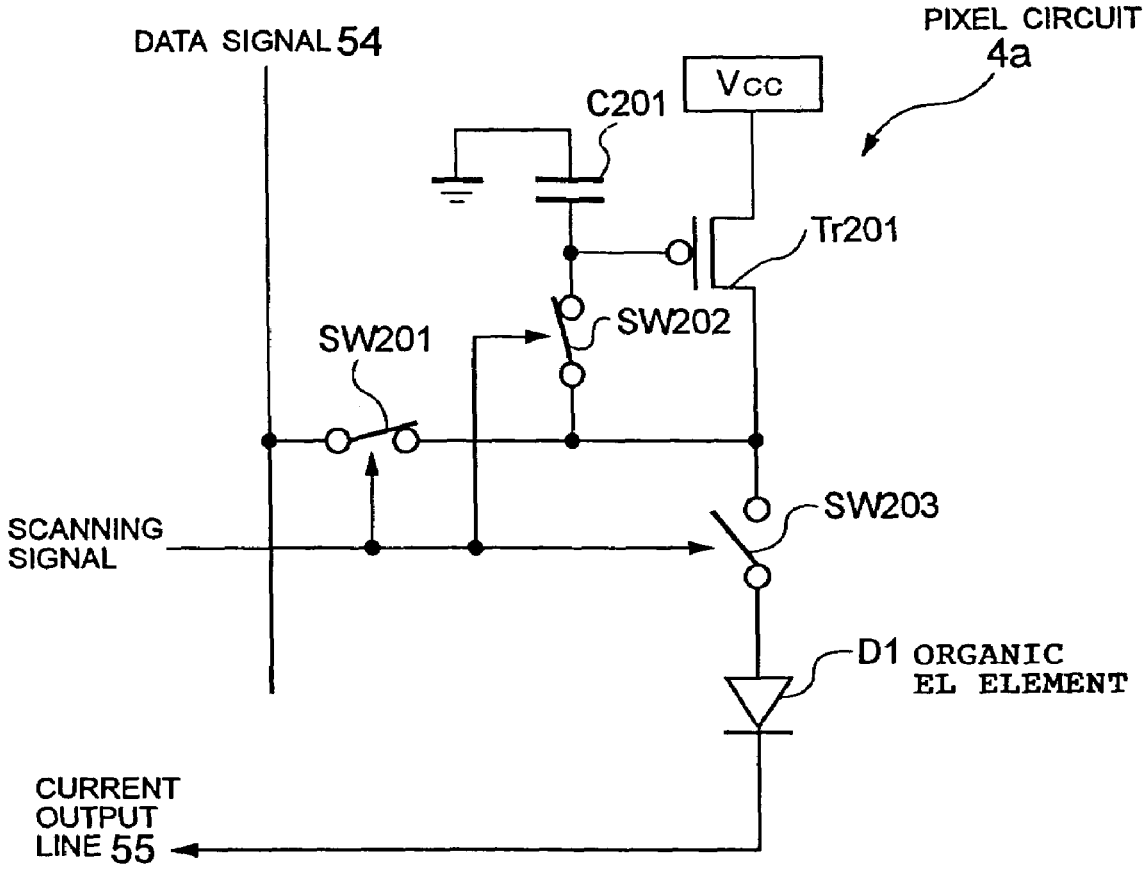
FIG. 8 is a circuit showing pixel circuits 4*a* arranged to the display portion 4 shown in FIG. 1 like a matrix.

FIG. 8 is a circuit diagram of pixel circuits constituting the display portion 4. The pixel circuit is also constituted by a current copier circuit including a transistor Tr201 for storing and outputting a current, an electrostatic capacitor C201 for holing a gate voltage, storing switches SW201 and SW202, a current output switch SW203, and an organic EL element D1.

The cathode of the organic EL element D1 is connected to all pixels in common to serve as a current output line 55. The current output line 55 is connected to earth (GND) by the switch SW1 (refer to FIG. 1) under the normal operation and connected to a current detection resistance R1 by the switch SW1 under the current adjustment operation. A control signal for switching the switch SW1 is output by the current adjustment control circuit 1. A voltage generated by the resistance R1 serves as a current detection signal 56. It is preferable to form the resistance R1 as a resistance of a minimum value in a range in which it can be detected. Therefore, it is preferable to properly select a resistance used by a current value to be detected by using a plurality of resistances.

Scanning signals for controlling the switches SW201 to SW203 are output from a not-illustrated gate driver circuit set to the outside. Moreover, to distinguish between the storage operation and the current output operation, the switch SW203 is opened at the time of the storage operation, that is, when the switches SW201 and SW202 are closed and the switches SW201 and SW202 are opened at the time of the current output operation, that is, when the switch SW203 is closed. As a result, currents corresponding to 64 gradations output from the D/I converter 3*d* are stored in the transistor Tr201 at the time of the storage operation and the stored current is supplied to the organic EL element D1 at the time of the current output and the organic EL element D1 emits light at 64 gradations, that is, at the brightness of 64 gradations.

Operations of this embodiment are described below. Before displaying an image in the present display device, a gradation current is adjusted. It is preferable to previously perform the adjustment before shipping the display device. The method for adjusting the gradation current is described below.

Adjustment of the gradation current is performed in order of R (red), G (green), and B (blue) which are primary colors. It is assumed that the adjustment is performed in order of i1, i2, i3, i4, i5, and i6 starting with the smallest current for each color. First, the present state is switched to the output side of the adjusting image signal generator 1*g* by a switch 1*h* of the current adjustment control circuit 1. Then, the selecting circuit if outputs the selection signal 61 for adjusting the reference current i1 of R. In response to the selection signal 61, the adjusting image signal generator 1*g* outputs a 6-bit image signal of R of #000001 in binary notation and 6-bit image signals of C and B of #000000 to the current driver 3 as the image signals 52.

At the same time, the set-value storing circuit 1*a* outputs the predetermined initial digital adjustment signal 62 to the comparing and computing circuit 1*c* in order to adjust the reference current i1 of R, and the comparing and computing circuit 1*c* directly outputs the initial digital adjustment signal 62 to the DA converter 1*d* through the switch 11*d*. The initial digital adjustment signal 62 is input to a DA converter R1, converted into an analog signal by the DA converter R1, and then output to a circuit block corresponding to i1 of R of the reference current circuit 2 as the current adjustment voltage 51.

The reference current circuit 2 generates the current of the reference current signal 53 (i1-R) corresponding to the current adjustment voltage 51 and outputs it to the current driver 3. The current driver 3 stores the current of the reference current signal 53 (i1-R) by the current copier circuit i1-R and outputs and sends the current to a pixel circuit. In this case, the digital image signal 53 (i1-R) input to the current copier circuit i1-R is kept at high level in all current copier circuits i1-R by the adjusting image signal 52. Therefore, a current equal to the reference current signal 53 (i1-R) is written in all pixel circuits of the display portion, and a current equal to the reference current signal 53 (i1-R) circulates in all organic EL element of R. The current at this time is measured by the current detecting circuit 5 and the measurement result is output to the current adjustment control circuit 1 as the current detection signal 56.

The current adjustment control circuit 1 converts the current detection signal 56 into a digital value by the AD converter 1*e* and compares the digital value with a target value output from the reference value storing circuit 1*b* in the comparing and computing circuit 1*c*. As a result of the comparison, when the target value is larger, the digital adjustment signal 62 is changed to a large value but when the target value is smaller, the digital adjustment signal 62 is changed to a smaller value and output to the DA converter 1*d* again. The above operation is repeated until the digital current detection signal 63 becomes equal to the target value output from the reference value storing circuit 1*b*.

When the digital current detection signal 63 becomes equal to the target value, the comparing and computing circuit 1*c* outputs the digital value of the digital adjustment signal 62 output at that time to the set value storing circuit 1*a* and the set value storing circuit 1*a* stores the digital value as the i1 adjustment value of R. Then, the selecting circuit if changes an output to the selection signal 61 for the reference current i2 of R and the reference current i2 of R is adjusted in accordance with the same procedure.

The above adjustment is performed for reference current circuit blocks of six for each of RGB, that is, the total of 18. When all adjustments are completed, the current ratio of the reference current signal 53 is set to i1:i2:i3:i4:i5:i6=1:2:4:8:16:32 in each of RGB and 18 adjustment values are stored in the set value storing circuit 1*a*. By changing a target value to be stored in the reference value storing circuit 1*b* every RGB, adjustment corresponding to the device characteristic of each of RGB can be made.

When actually using an adjusted display device of the present invention before shipping it, the display device is turned on and then the comparing and computing circuit 1*c* sequentially reads 18 adjustment values stored in the set value storing circuit 1*a* and outputs the values to the DA converter 1*d* as digital adjustment signals 62. The DA converter 1*d* converts the digital adjustment signals 62 into analog signals (current adjustment voltages 51) and outputs them to the reference current circuit 2. As a result, the reference current circuit 2 outputs the reference current signal 53 same as the time of adjustment to the current driver 3 and accurate 64-gradation display is executed in the display portion 4.

Figure 9:
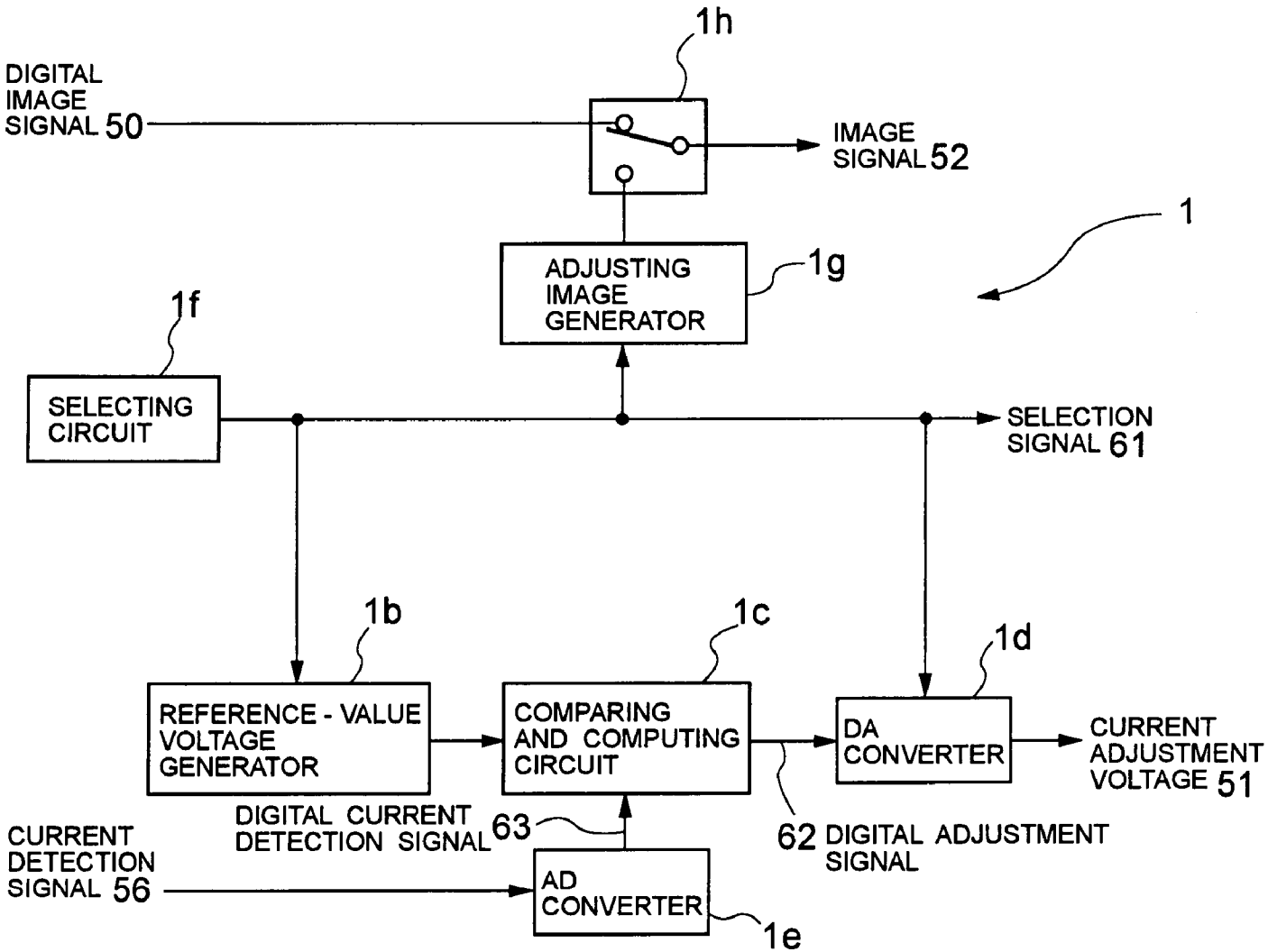
FIG. 9 is another block diagram showing the current adjustment control circuit 1 shown in FIG. 1.

The above described is the operation when performing adjustment before shipment. Then, a method for executing adjustment whenever power is turned on not before shipment is described below. FIG. 9 is an internal block diagram of the current adjustment control circuit 1 when executing adjustment after power is turned on. When executing adjustment before shipment, it is necessary to store an adjustment value in the set value storing circuit 1*a* (refer to FIG. 3). However, when executing adjustment after power is turned on, it is not necessary to store an adjustment value in the set value storing circuit 1*a*. Therefore, the set value storing circuit 1*a* is deleted. Other circuits are the same as the case of executing adjustment before shipment.

When power is turned on, currents are first adjusted. The adjustment sequence is the same as the case of executing adjustment before shipment. Firstly, the present state is switched to the output side of the adjusting image signal generator 1*g* by the switch 1*h* of the current adjustment control circuit 1. Moreover, all the DA converters in the DA converter 1*d* are initialized at the same time as power-on and a voltage output is set to 0 V.

Then, the selecting circuit if outputs the selection signal 61 for adjusting the reference current i1 of R. The adjusting image signal generator 1*g* outputs a 6-bit image signal of R of #000001 and 6-bit image signals of G and B of #000000 in binary notation to the current driver 3 as image signals 52 in accordance with the selection signal 61.

The reference current circuit 2 does not output a current yet because a current adjustment voltage output by the DA converter 1*d* is 0 V and a current setting transistor is turned off. Therefore, because no current is supplied to the current driver 3 or a pixel circuit, no current circulates through the organic EL element and thereby, a current detection result becomes zero.

The comparing and computing circuit 1*c* compares a current with the target value of the reference current i1 of R output from the reference value storing circuit 1*b*. As a result of the comparison, because the target value is larger, the comparing and computing circuit 1*c* changes the digital adjustment signal 62 to a large value and outputs it to the DA converter 1*d*. By repeating this operation, the digital current detection signal 63 output from the AD converter 1*e* continuously increases. When the digital current detection signal 63 becomes equal to the target value output from the reference value storing circuit 1*b*, adjustment of the reference current i1 of R is completed. The DA converter R1 keeps the above state until the power supply is turned off. Then, the selecting circuit 1*f* changes the output to the selection signal 61 for the reference current 12 of R and the reference current i2 of R is adjusted in accordance with the same procedure.

The above adjustment is executed for the total of 18 reference current blocks of six colors of each of RGB. When all adjustments are completed, 18 outputs of the DA converter 1*d* are adjusted and standby for outputting, and the current ratio of the reference current signal 53 is set to i1:i2:i3:i4:i5:i6=1:2:4:8:16:32 in each of RGB. When the adjustment is completed, the present state is by the switch 1*h* of the current adjustment control circuit 1 switched to the digital image signal 50 input from the outside and accurate display of 64 gradations is executed in the display portion 4.

Figure 10:
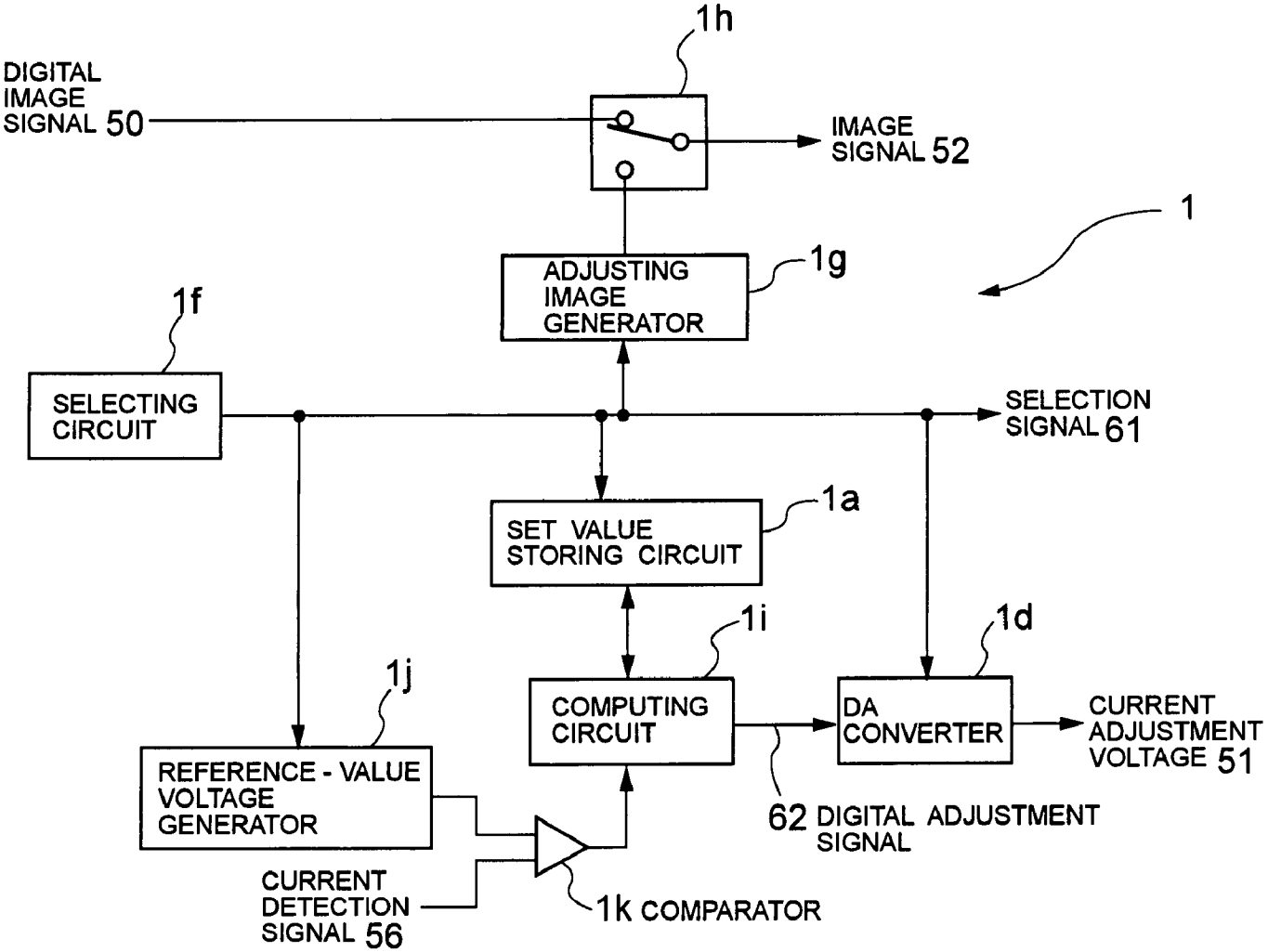
FIG. 10 is still another block diagram showing the current adjustment control circuit 1 shown in FIG. 1.

First, FIG. 10 shows another example of the current adjustment control circuit 1 shown in FIG. 1. The current adjustment control circuit 1 shown in FIG. 3 digitally compares a reference value with a current detection result by the AD converter 1*e*, reference value storing circuit 1*b*, and comparing and computing circuit 1*c*. However, the current adjustment control circuit 1 shown in FIG. 10 is changed so as to analogously perform comparison by using a reference voltage generator 1*j* and comparator 1*k*. However, the adjusting method is the same. A computing circuit 1*i* adjusts the digital adjustment signal 62 in accordance with the output state of the comparator 1*k* and stores the digital value of the digital adjustment signal 62 in the set value storing circuit 1*a* when it becomes equal to the reference value. This method has an advantage for reducing the cost of a display device because no AD converter is used.

Figure 11:
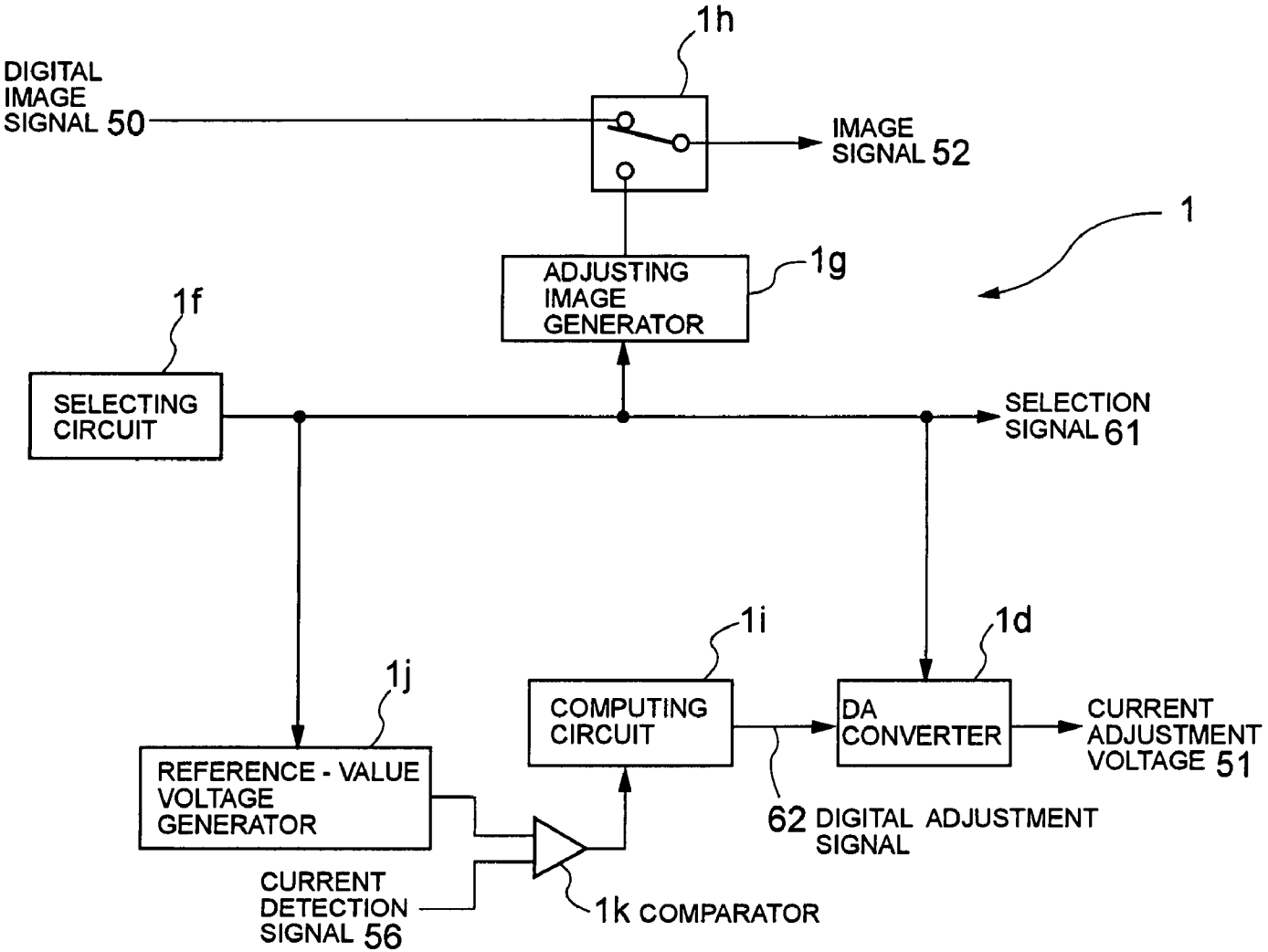
FIG. 11 is still another block diagram showing the current adjustment control circuit 1 shown in FIG. 1.

The configuration of FIG. 10 corresponds to a case of performing adjustment before shipment. FIG. 11 shows a circuit block diagram of the current adjustment control circuit 1 when performing adjustment after power is turned on. When executing adjustment after power is turned on similarly to the case of the configuration in FIGS. 3 and 9, the set value storing circuit 1*a* is deleted because it is not necessary to store an adjustment value in the set value storing circuit 1*a*. Operations of circuits other than the set value storing circuit 1*a* are the same as those in FIG. 10.

Figure 12:
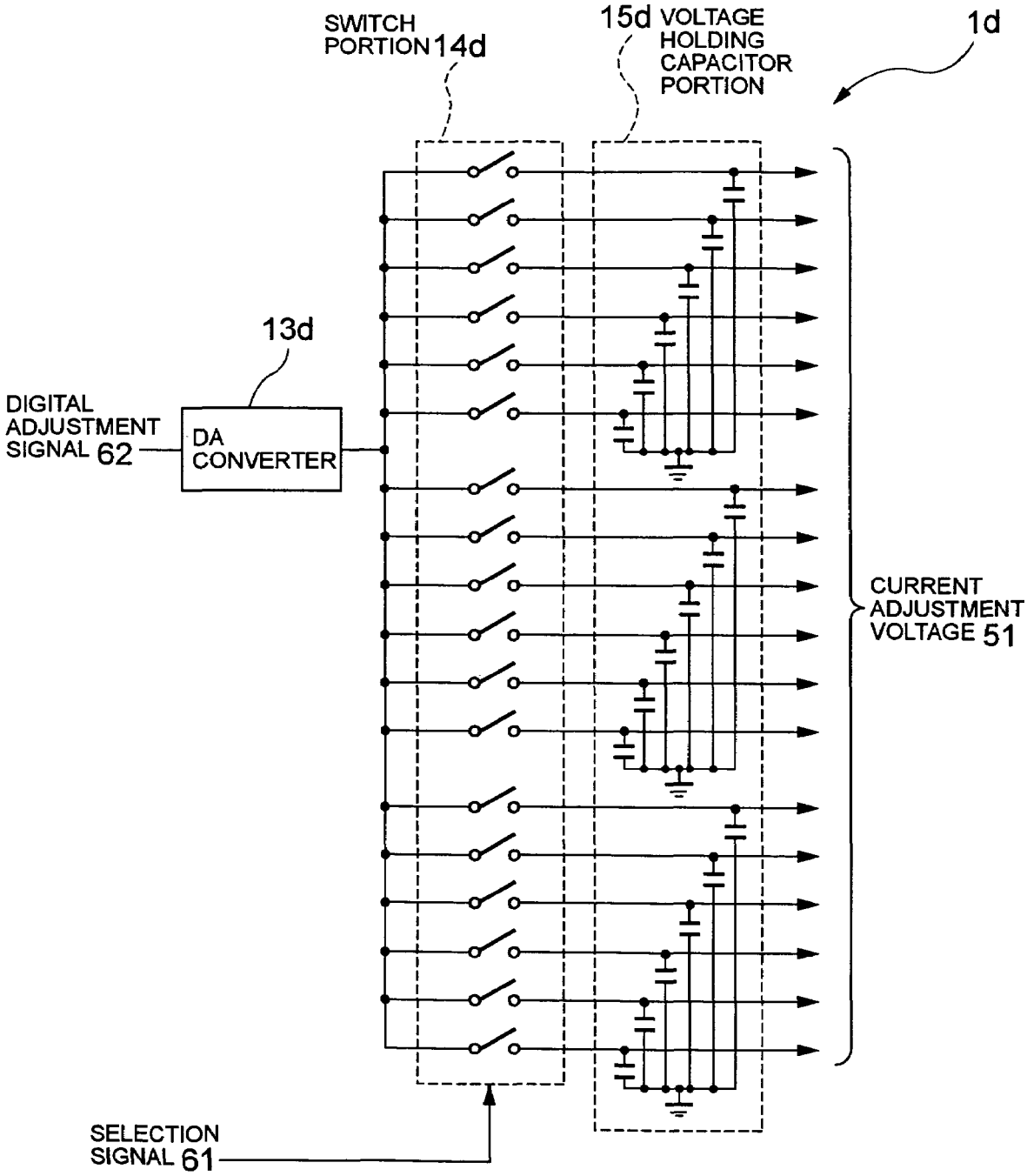
FIG. 12 is a circuit diagram showing another example of the inside of the DA converter 1*d* shown in FIG. 3.
Figure 13:
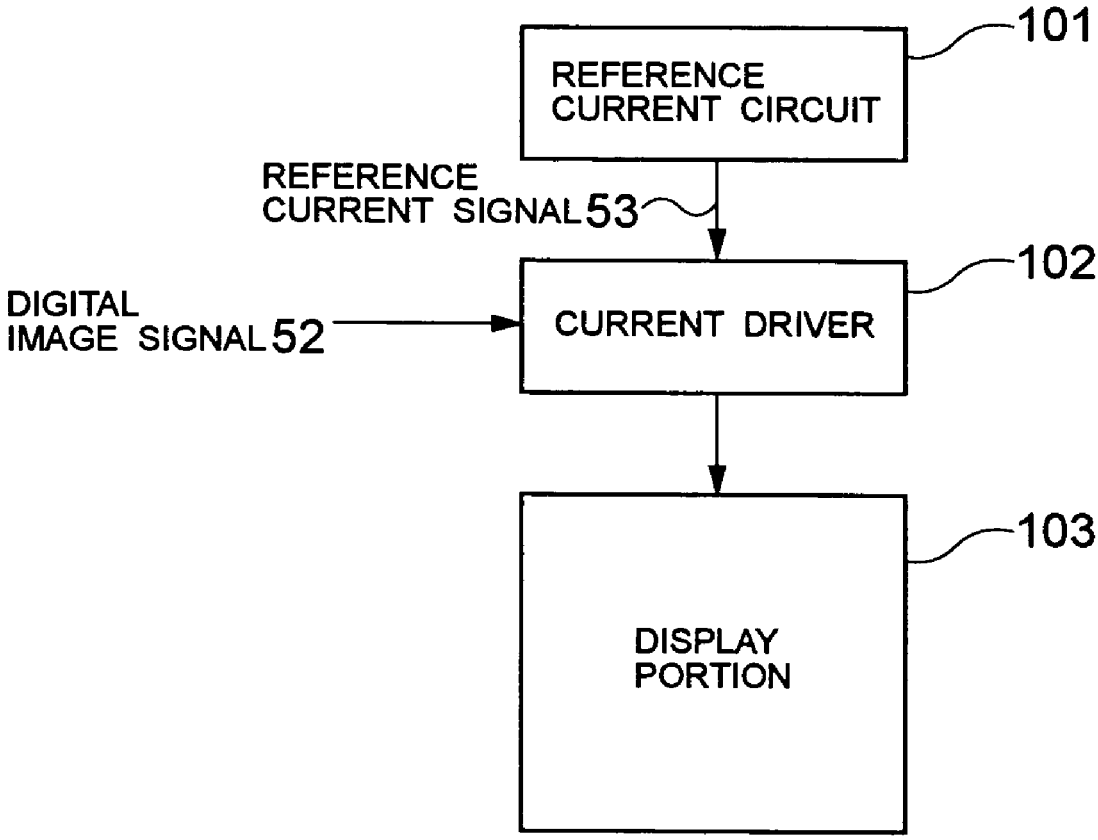
FIG. 13 PRIOR ART
FIG. 13 is a general circuit block diagram showing a configuration of a conventional display device.
Figure 14:
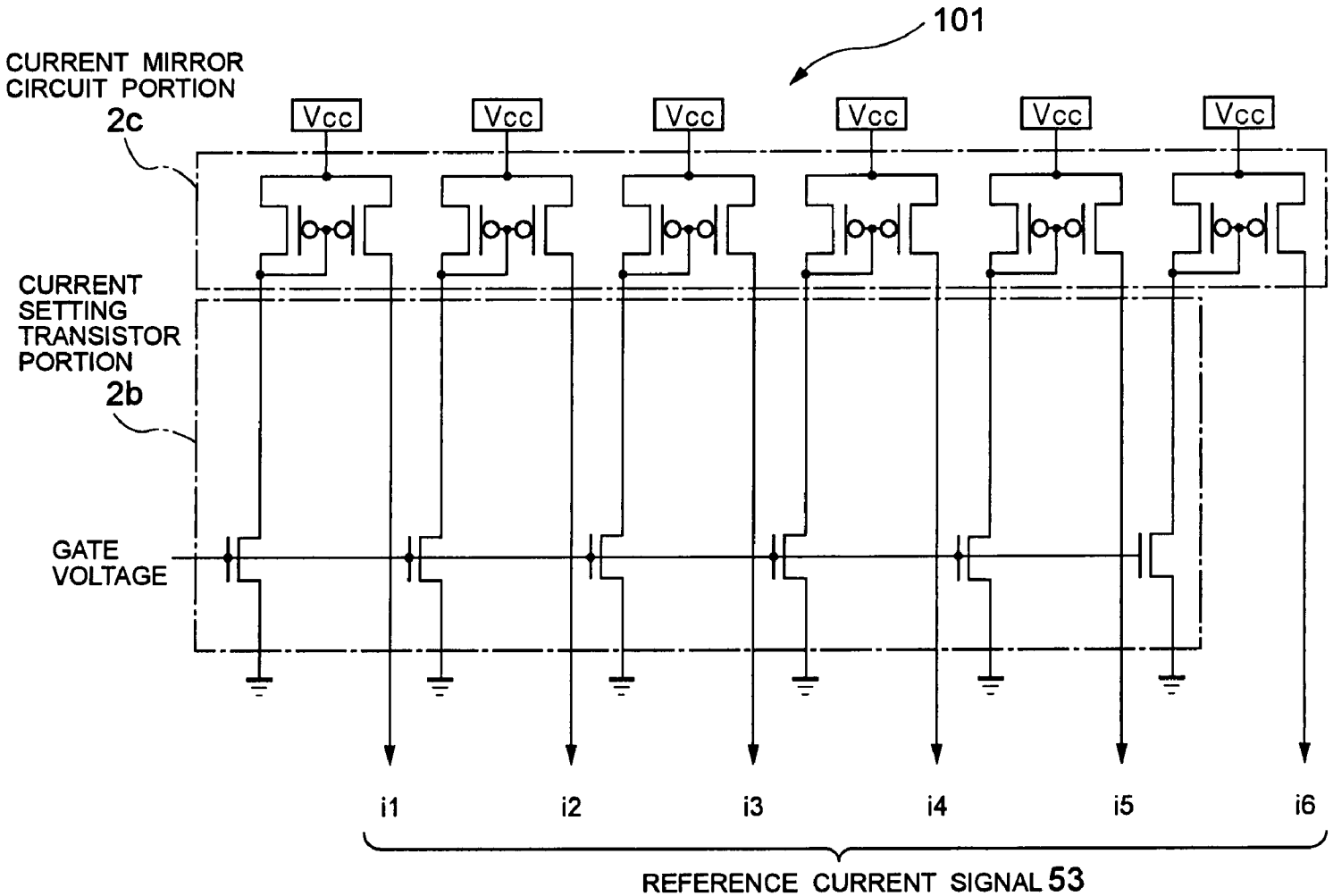
FIG. 14 PRIOR ART
FIG. 14 is a circuit diagram showing a conventional reference current circuit.
Figure 15:
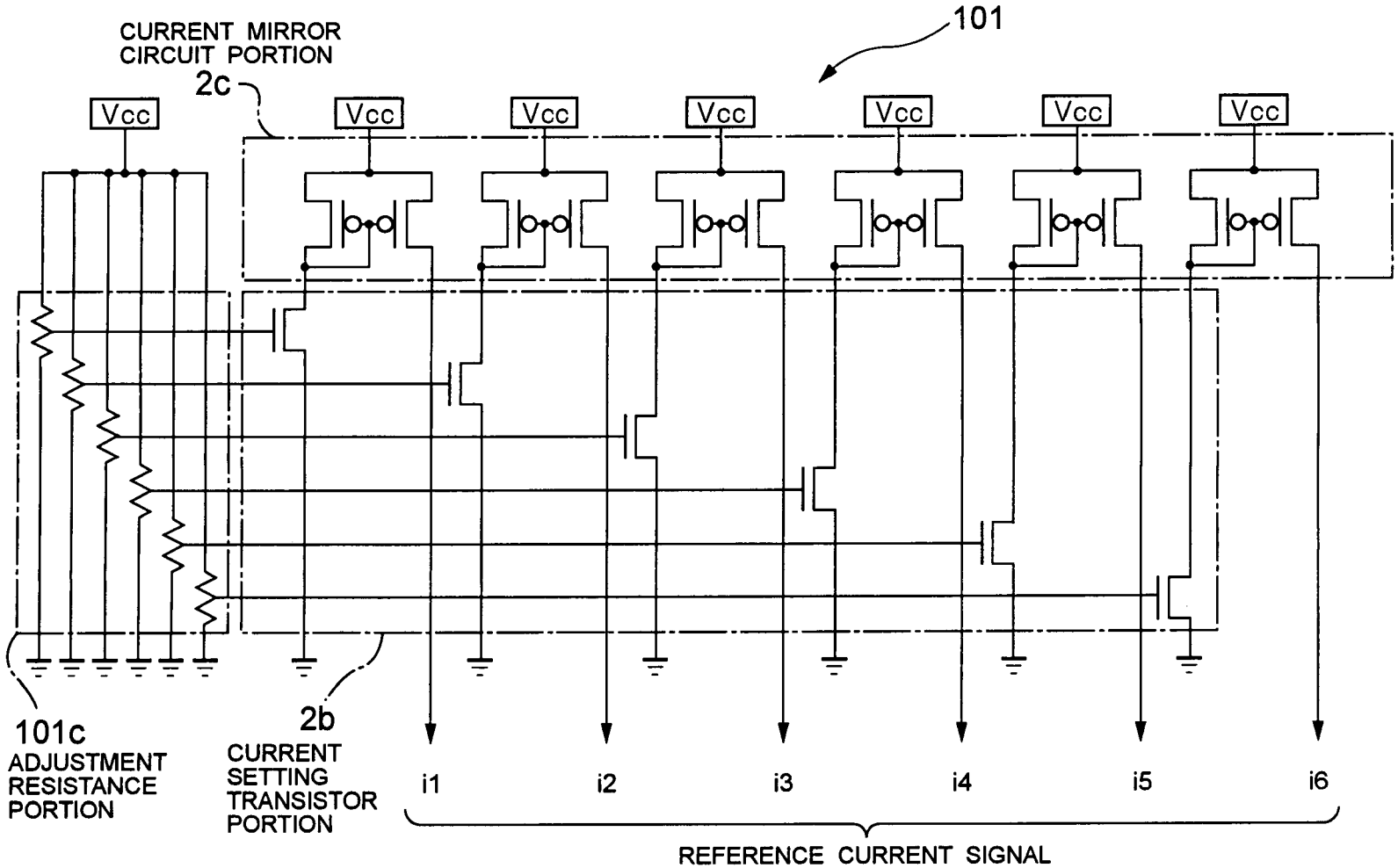
FIG. 15 PRIOR ART
FIG. 15 is a circuit diagram showing another conventional reference current circuit.

FIG. 12 shows an internal circuit of the DA converter 1*d* shown in FIG. 3. The DA converter 1*d* shown in FIG. 4 is constituted by the total of 18 DA converter circuits of six converters for each of RGB. However, the DA converter 1*d* shown in FIG. 12 is constituted only by the DA converter circuit 13*d*. In this case, to hold the current adjustment voltage 51, a voltage holding capacitor portion 15*d* is connected to the signal line of each current adjustment voltage 51. The DA converter 1*d* shown in FIG. 4 outputs the digital adjustment signal 62 only once after power is turned on. In this case, however, it is preferable to perform rewriting at an interval in which the voltage of each signal line of the current adjustment voltages 51 is not changed due to a leak current. Because this method can decrease the number of DA converters to 1/18, it is possible to reduce the cost of a display device.

As described above, even if there is a variation in current setting transistors of a reference current circuit, a reference current can be accurately generated. Therefore, it is possible to form the reference current circuit on the same substrate as a glass substrate on which a display portion is formed and arranged the reference current circuit nearby a current driver, and thus an object of the present invention can be achieved.

When performing adjustment before shipment, it is possible to delete the selecting circuit 1*f*, reference value storing circuit 1*b*, comparing and computing circuit 1*c*, AD converter 1*e*, and switch 1*h* which are necessary only for the adjustment among the circuits shown in FIG. 3 constituting the current adjustment and control circuit 1 because they are not necessary to ship a product. A set value obtained through the adjustment after the product is shipped and power is turned on is output from the set value storing circuit 1*a* to the DA converter 1*d* and thereby, a reference current is set. The same is applied to the case of the configuration of FIG. 10.

Moreover, when considering a change of temperatures, it is considered that an error occurs in the reference current signal 53 due to the temperature characteristic of the current setting transistor (refer to 2*b* in FIG. 2) constituting the reference current circuit 2. To restrain the influence, it is possible to correct the error by setting a temperature sensor, storing a plurality of set values corresponding to temperatures at the time of adjustment before shipment in the set value storing circuit 1*a*, and changing outputs to the DA converter 1*d* in accordance with an output of the temperature sensor. However, when performing adjustment whenever power is turned on, correction can be made by performing readjustment in accordance with an output of the temperature sensor.

Moreover, according to the present invention, even if not only an error occurs in the reference current circuit 2 but also an error occurs in a current driver or pixel circuit, it is possible to perform correction by including the error. Furthermore, as an embodiment of the present invention, a display device using organic EL elements different for RGB is described as an example. However, the present invention can be applied to a display device using one or more organic EL elements such as a color filter system or color conversion system. Furthermore, though an organic EL element constituting a display portion is used for current adjustment, it is also allowed to perform adjustment by using an organic EL element formed on a position other than a display region.

According to the present invention, a reference current for generating a driving current to be supplied to a current-driving-type display device is adjusted by using a closed-loop configuration. Therefore, advantages are obtained that the reference current can be accurately adjusted even if transistors constituting a reference current circuit are fluctuated and thereby, a display device capable of clearly displaying a gradation can be obtained. Moreover, because an accurate reference current circuit can be formed on a glass substrate, advantages are obtained that it is possible to arrange the reference current circuit nearby a current driver, decrease the parasitic capacitance parasitized on an output line of the reference current circuit, and accurately supply even a small current to the current driver.

Furthermore, according to the present invention, it is possible to accurately adjust a reference current without using a variable resistance for adjusting a reference current at the outside. Therefore, advantages can be obtained that it is possible to improve the productivity and obtain a low-price display device.

What is claimed is:

1. A display driving circuit which comprises:

reference-current supplying means including a voltage controlled current supplier for supplying a reference current to at least one current driver circuit;

the current driver circuit for outputting a driving current to a light emitting element based on said reference current;

comparing means for comparing at least one driving current supplied to the light emitting element with a target value; and adjusting means for adjusting the reference current in accordance with the comparison result, wherein current adjustment voltage is supplied to said voltage controlled current supplier to vary the reference current supplied.

2. The display driving circuit according to claim 1, further comprising storing means for storing an adjustment value adjusted by the adjusting means.

3. The display driving circuit according to claim 2, wherein the adjustment value stored in the storing means is read to adjust the current of the reference-current supplying means in response to power-on.

4. The display driving circuit according to claim 1, wherein adjustment by the adjusting means is executed by using an adjusting image signal.

5. The display driving circuit according to claim 1, wherein the circuit is formed on the same substrate on which the light emitting element is formed.

6. The display driving circuit according to claim 1, wherein the reference-current supplying means is constituted so as to generate n reference currents for $2^n$ gradations every light color emitted from the light emitting element.

7. A display driving circuit comprising:

reference-current supplying means for supplying a reference current to at least one current driver circuit;

the current driver circuit for outputting a driving current to a light emitting element based on said reference current;

storing means for storing an adjustment value for adjusting the reference current of the reference-current supplying means; and adjustment means for reading the adjustment value stored in the storing means and adjusting the reference current in response to power-on, wherein said reference-current supplying means including a voltage controlled current supplier, wherein voltage is supplied to said reference-current supplying means to vary the reference current supplied.

8. The display driving circuit according to claim 7, wherein the adjustment value is obtained by using an adjusting image signal.

9. The display driving circuit according to claim 7, wherein the storing means previously stores a plurality of adjustment values corresponding to temperature.

10. The display driving circuit according to claim 9, wherein the adjusting means is operable to read an adjustment value corresponding to an ambient temperature from the storing means and is operable to perform adjustment.

11. The display driving circuit of claim 7, wherein the adjustment value is stored in the storing means prior to power-on.

12. A display device comprising a display driving circuit, the display driving circuit comprising:

reference-current supplying means for supplying a reference current to at least one current driver circuit;

the current driver circuit for outputting a driving current to a light emitting element based on said reference current;

comparing means for comparing at least one driving current supplied to the light emitting element with a target value; and adjusting means for adjusting the reference current in accordance with the comparison results, wherein said reference-current supplying means including a voltage controlled current supplier, wherein voltage is supplied to said reference-current supplying means to vary the reference current supplied.

13. A method of driving a display device comprising:

supplying a reference current;

outputting a driving current to a light emitting element based on said reference current;

measuring a current circulating in the light emitting element;

comparing a value based on the measured current with a target value; and adjusting the reference current in accordance with the comparison results, wherein said reference current is supplied by reference-current supplying means including a voltage controlled current supplier, wherein voltage is supplied to said reference-current supplying means to vary the reference current supplied.

14. The method of claim 13, wherein the reference current is adjusted until the value based on the measured current becomes equal to the target value.

* * * * *